US010234803B2

(12) United States Patent
Hashimoto

(10) Patent No.: US 10,234,803 B2
(45) Date of Patent: Mar. 19, 2019

(54) IMAGE HEATING DEVICE CAPABLE OF ENSURING AN ELECTRICAL INSULATION DISTANCE BETWEEN A ROTATABLE MEMBER AND A FRAME

(71) Applicant: CANON KABUSHIKI KAISHA, Tokyo (JP)

(72) Inventor: Yoshinori Hashimoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/888,565

(22) Filed: Feb. 5, 2018

(65) Prior Publication Data

US 2018/0224777 A1 Aug. 9, 2018

(30) Foreign Application Priority Data

Feb. 6, 2017 (JP) ..... 2017-019399

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2017; G03G 15/2032; G03G 15/2035; G03G 15/2053
USPC ..... 399/329
See application file for complete search history.

(56) References Cited

U.S. PATENT DOCUMENTS

| | | | | |
|---|---|---|---|---|
| 7,283,780 | B2 | 10/2007 | Uchida et al. | |
| 7,660,553 | B2 | 2/2010 | Kikuchi | |
| RE45,015 | E | 7/2014 | Uchida et al. | |
| 8,918,043 | B2 * | 12/2014 | Yoshida | G03G 15/2053 399/329 |
| 9,037,058 | B2 * | 5/2015 | Iwata | G03G 15/2053 399/329 |
| 2016/0154354 | A1 | 6/2016 | Cohta | |
| 2016/0327900 | A1 | 11/2016 | Tanaka et al. | |

FOREIGN PATENT DOCUMENTS

| | | | |
|---|---|---|---|
| JP | 2006-201370 | A | 8/2006 |
| JP | 2006-293225 | A | 10/2006 |
| JP | 2012-118408 | A | 6/2012 |
| JP | 2016-102988 | A | 6/2016 |

* cited by examiner

*Primary Examiner* — William J Royer
(74) *Attorney, Agent, or Firm* — Venable LLP

(57) ABSTRACT

An image heating device includes a cylindrical film, an opposing member opposing the film, an electroconductive frame, and a preventing member provided on the frame to prevent movement of the film and including a preventing surface contacting an end edge of the film when the film moves in a longitudinal direction thereof. The preventing member includes an enclosing portion extending from the preventing surface toward a central portion of the film with respect to the longitudinal direction so as to enclose an outer peripheral surface of a longitudinal end portion of the film, the enclosing portion being provided at a position at which the enclosing portion is in non contact with the outer peripheral surface of the film with respect to a radial direction of the film.

11 Claims, 11 Drawing Sheets

IMAGE HEATING DEVICE CAPABLE OF ENSURING AN ELECTRICAL INSULATION DISTANCE BETWEEN A ROTATABLE MEMBER AND A FRAME

CLAIM TO PRIORITY

This application claims the benefit of Japanese Patent Application No. 2017/019399 filed on Feb. 6, 2017, which is hereby incorporated by reference herein in its entirety.

BACKGROUND OF THE INVENTION

The present invention relates to an image heating device suitable when used as a fixing device (for fixing a toner image on a recording material under application of heat and pressure) mounted in an image forming apparatus, such as a copying machine, a printer, a facsimile, or a multi function machine having a plurality of functions of these machines.

As the fixing device (image heating device) used in the image forming apparatus of an electrophotographic type, a fixing device of a film type including a fixing film moving in contact with a heating member (heater) (hereafter, the fixing film is referred to as a rotatable member) has been known (Japanese Laid Open Patent Application 2006 293225). This fixing device has good heat transfer efficiency and, therefore, has an advantage such that a time from a start of energization to the heating member (heater) until a temperature reaches a fixable temperature is short and a time, until an image formed on a first sheet is outputted, is short. Further, the fixing device also has an advantage such that electrical power consumption during a stand by state waiting for a print instruction is low, and thus, is introduced in many image forming apparatuses in recent years.

In such a fixing device of the film type, at a position opposing an end edge of the rotatable member, a flange (rotatable member supporting member) for regulating a position of the rotatable member with respect to a thrust direction is provided. The flange is engaged with an electroconductive (device) frame (casing of the fixing device) formed with a metal plate.

By applying an electrical bias voltage to the rotatable member, unfixed toner on a recording material is prevented from being deposited on a rotatable member and a pressing roller for forming a nip in cooperation with the rotatable member.

Further, a constitution in which, in order to prevent leakage of the bias voltage applied to the rotatable member to the frame, a distance between the rotatable member and the frame satisfies an electrical insulation distance is employed. That is, the fixing device is constituted so as to sufficiently ensure a size of a rotatable member end portion regulating surface with respect to a radial direction of the flange and so as to ensure electrical air clearance and creepage distance between the rotatable member end edge and the frame.

However, with recent downsizing of the image forming apparatus, when a configuration space of internal component parts of the fixing device decreases, the flange is required to decrease the rotatable member end portion regulating surface, so that it has become difficult to ensure the electrical air clearance and creepage distance.

Thus, the fixing device that compatibly realizes the downsizing of the fixing device (image heating device) and ensuring of the electrical insulation distance between the rotatable member and the frame is desired.

SUMMARY OF THE INVENTION

The present invention has been accomplished in view of the circumstances described above. A principal object of the present invention is to provide an image heating device capable of sufficiently ensuring an electrical insulation distance between a rotatable member and a frame while realizing downsizing thereof.

According to one aspect, the present invention provides an image heating device for heating a toner image while nipping and feeding a recording material carrying the toner image at a nip, the image heating device comprising, an opposing member opposing the film to form the nip between itself and the film, an electroconductive frame, and a preventing member provided on the frame to prevent movement of the film and including a preventing surface contacting an end edge of the film when the film moves in a longitudinal direction thereof, wherein the preventing member includes an enclosing portion extending from the preventing surface toward a central portion of the film with respect to the longitudinal direction so as to enclose an outer peripheral surface of a longitudinal end portion of the film, the enclosing portion being provided in a position where the enclosing portion is in non contact with the outer peripheral surface of the film with respect to a radial direction of the film.

Further features of the present invention will become apparent from the following description of exemplary embodiments with reference to the attached drawings.

Figure 3:
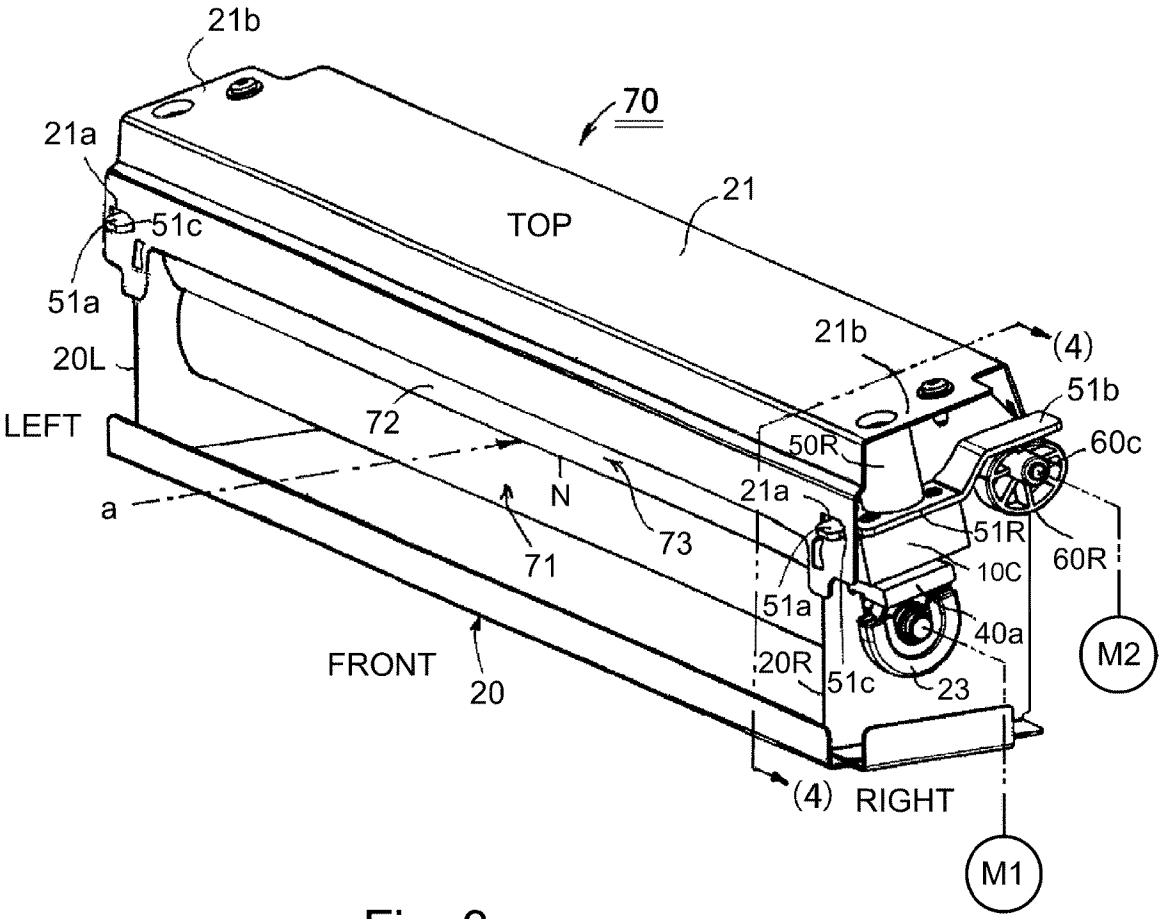
FIG. 3 is a perspective view of an outer appearance of the fixing device.
Figure 4:
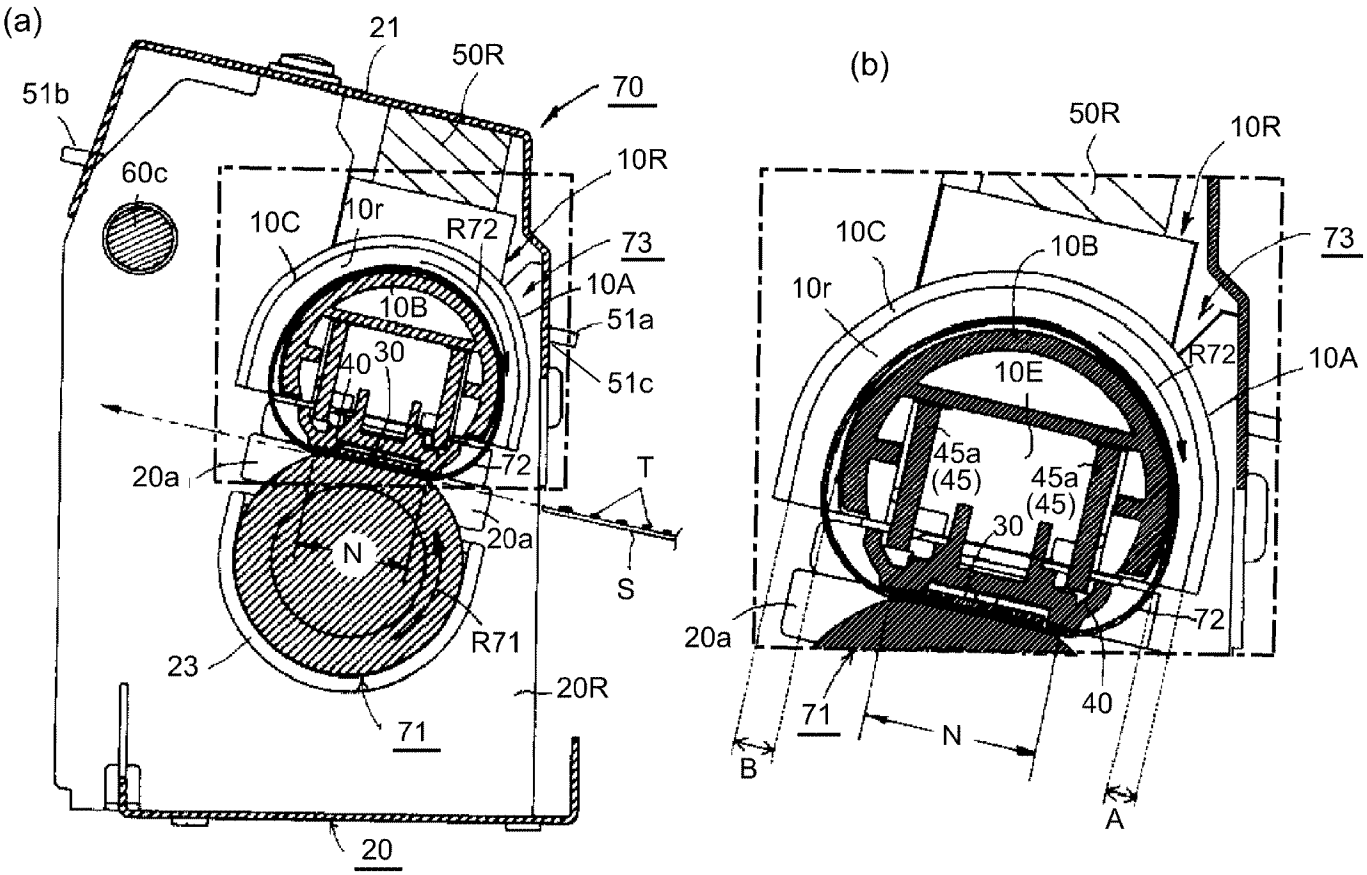

Part (a) of FIG. 4 is a sectional view of the fixing device at a position of (4) (4) line indicated in FIG. 3, and part (b) of FIG. 4 is a partially enlarged view of the part (a) of FIG. 4.

Figure 5:
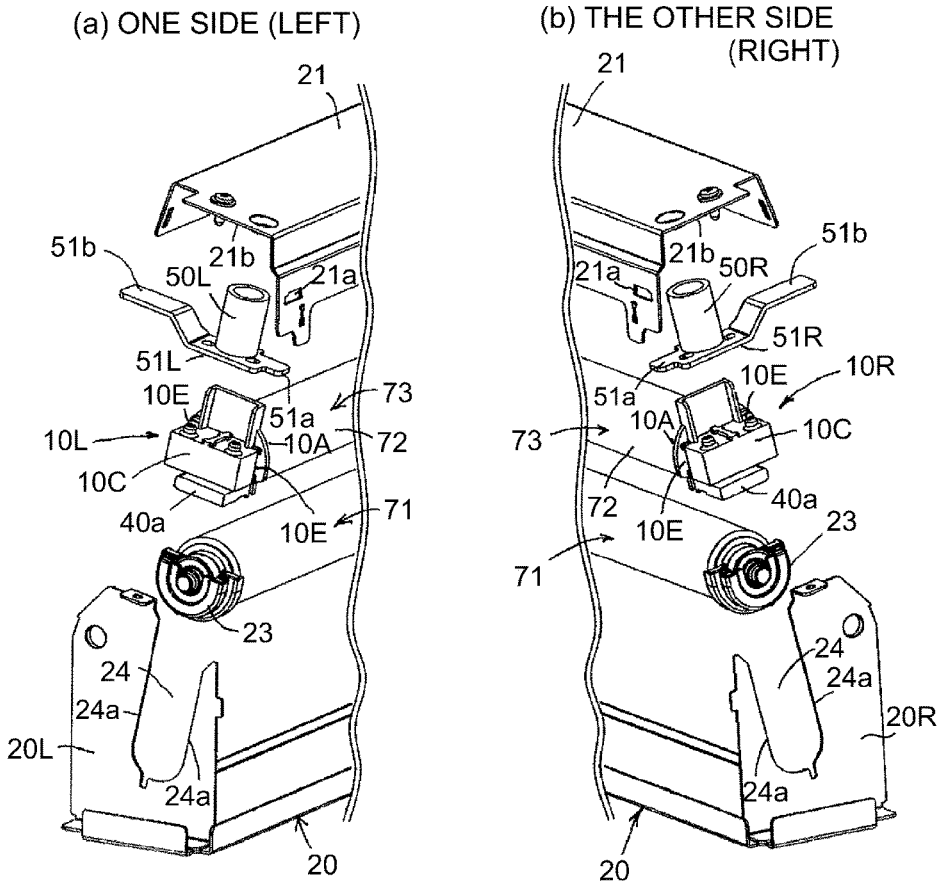

Parts (a) and (b) of FIG. 5 are exploded perspective views of the fixing device, in which part (a) shows one end side (left side) of the fixing device, and part (b) shows the other end side (right side) of the fixing device.

Figure 6:
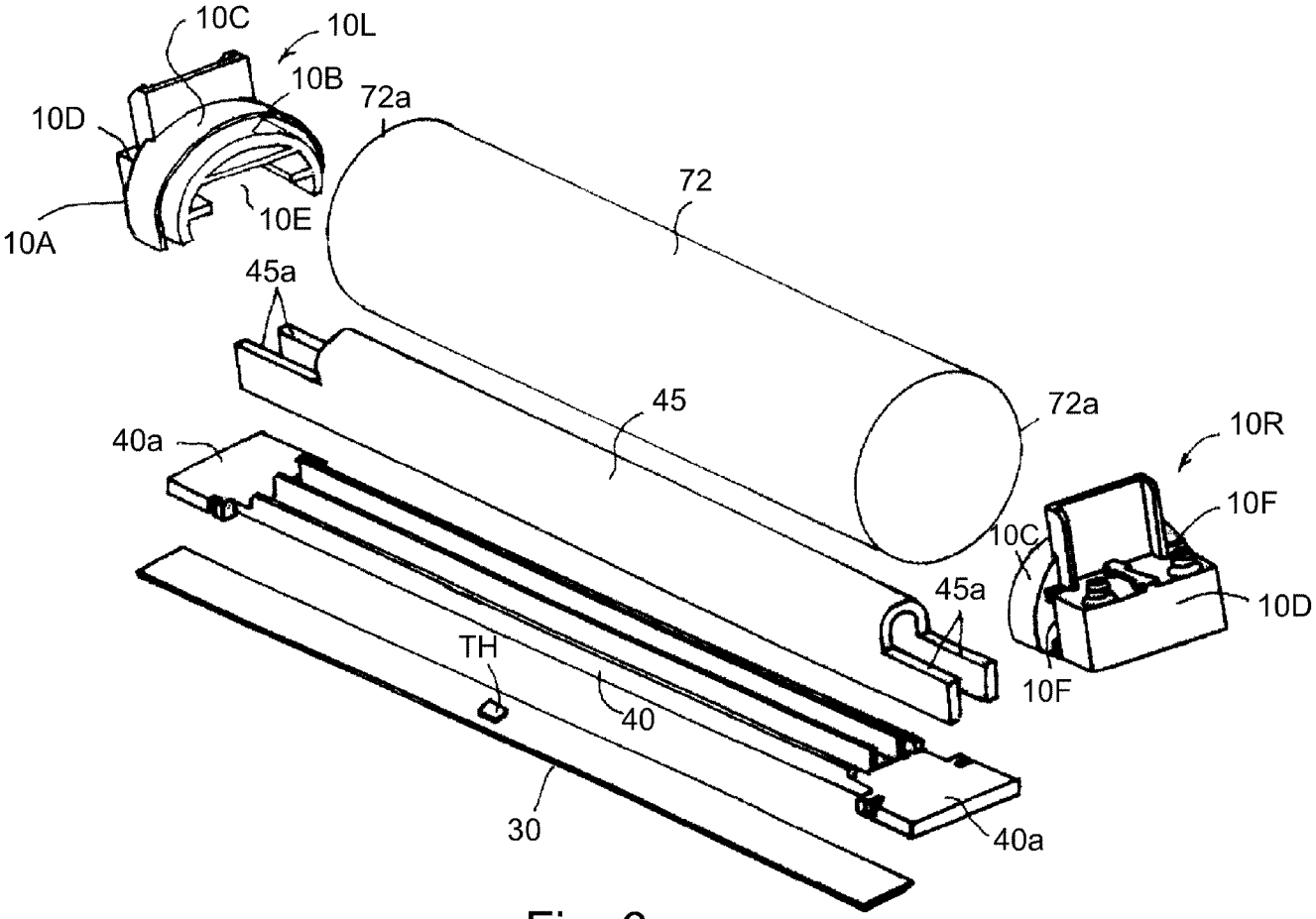

FIG. 6 is an exploded perspective view of a film unit.

Figure 7:
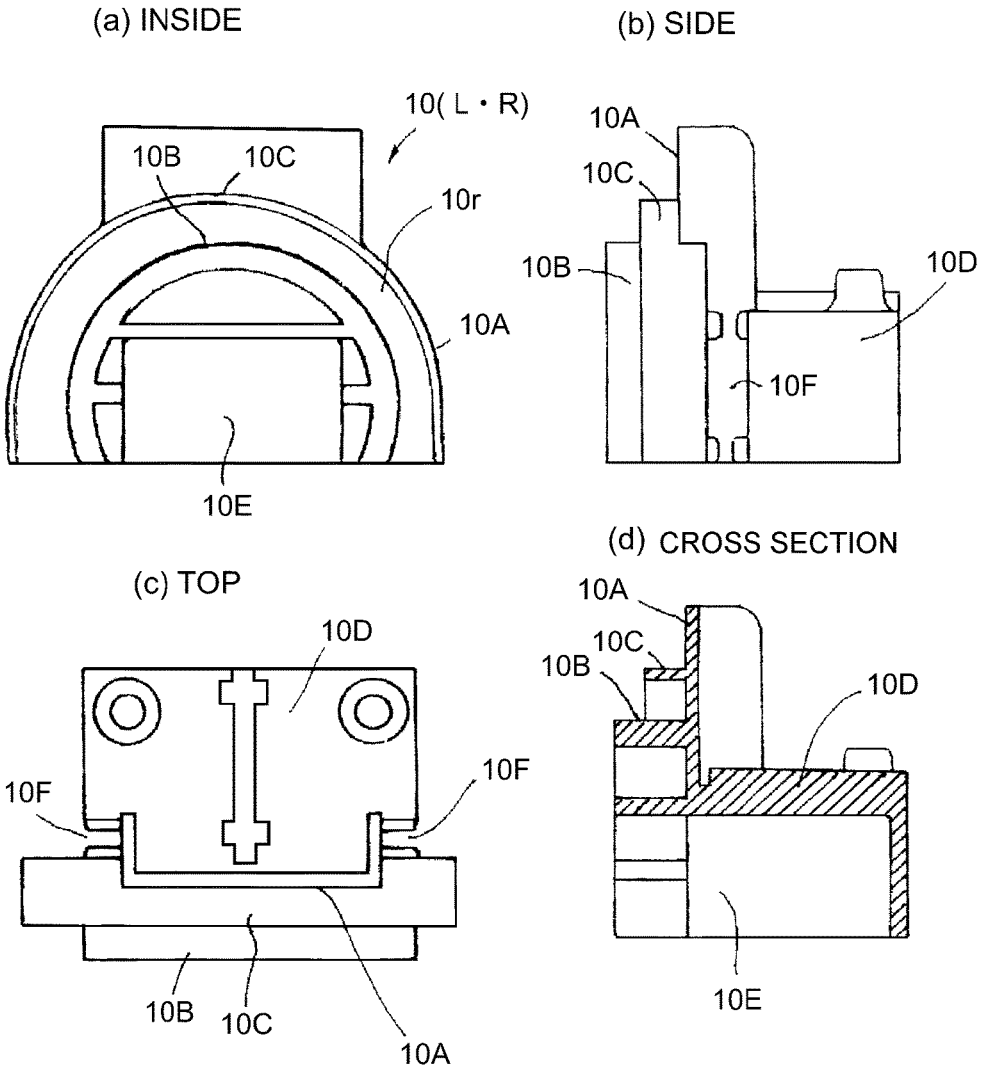

Parts (a) to (d) of FIG. 7 are schematic views for illustrating a structure of a flange, in which part (a) shows an inner surface of the flange, the part (b) shows a side surface of the flange, part (c) shows a top surface of the flange, and part (d) shows a cross sectional surface of the flange.

Figure 8:
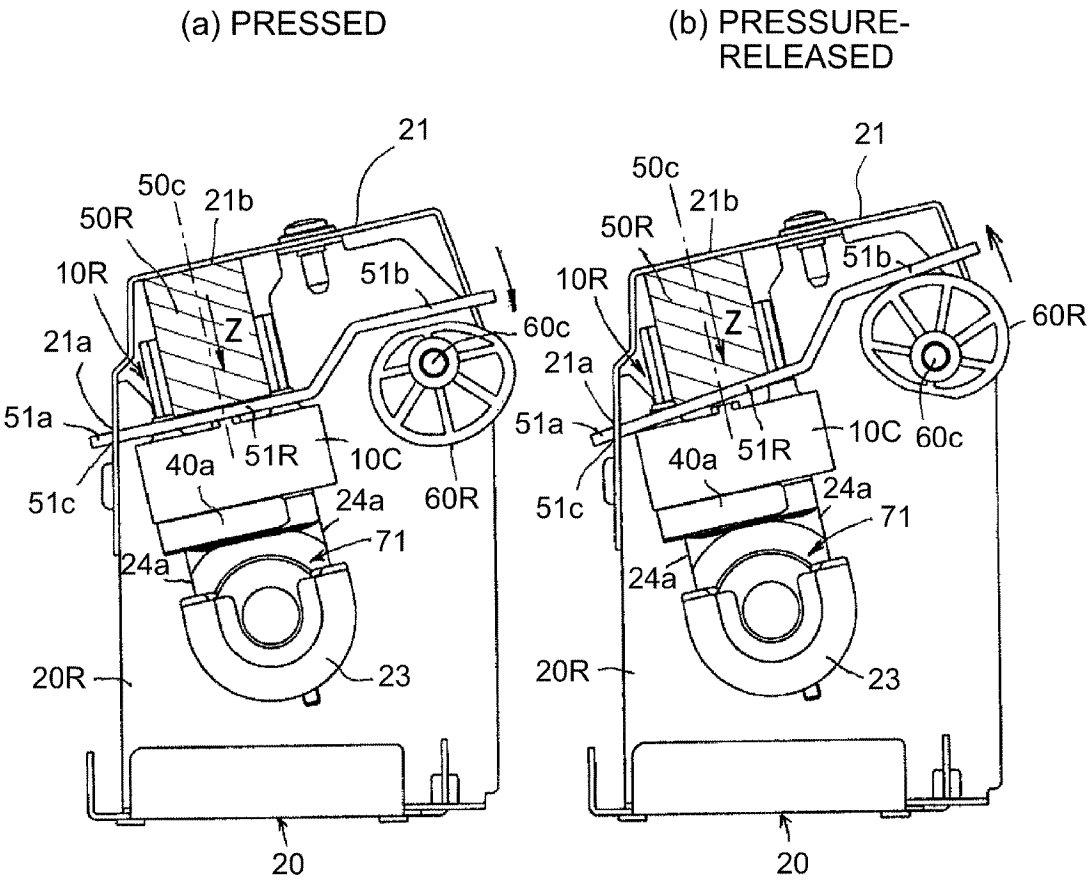

Part (a) of FIG. 8 is a right side view of the fixing device in a pressure applied state, and part (b) of FIG. 8 is a right side view of the fixing device in a pressure released state.

Figure 9:
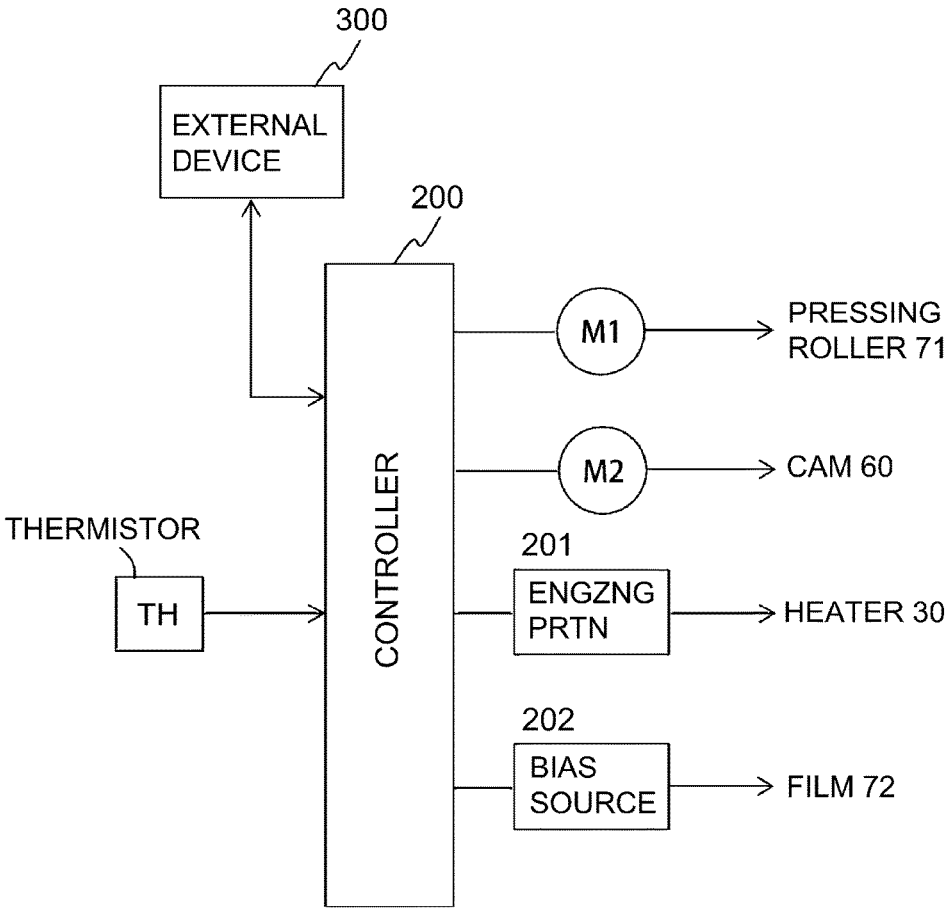

FIG. 9 is a block diagram of a control system.

Figure 10:
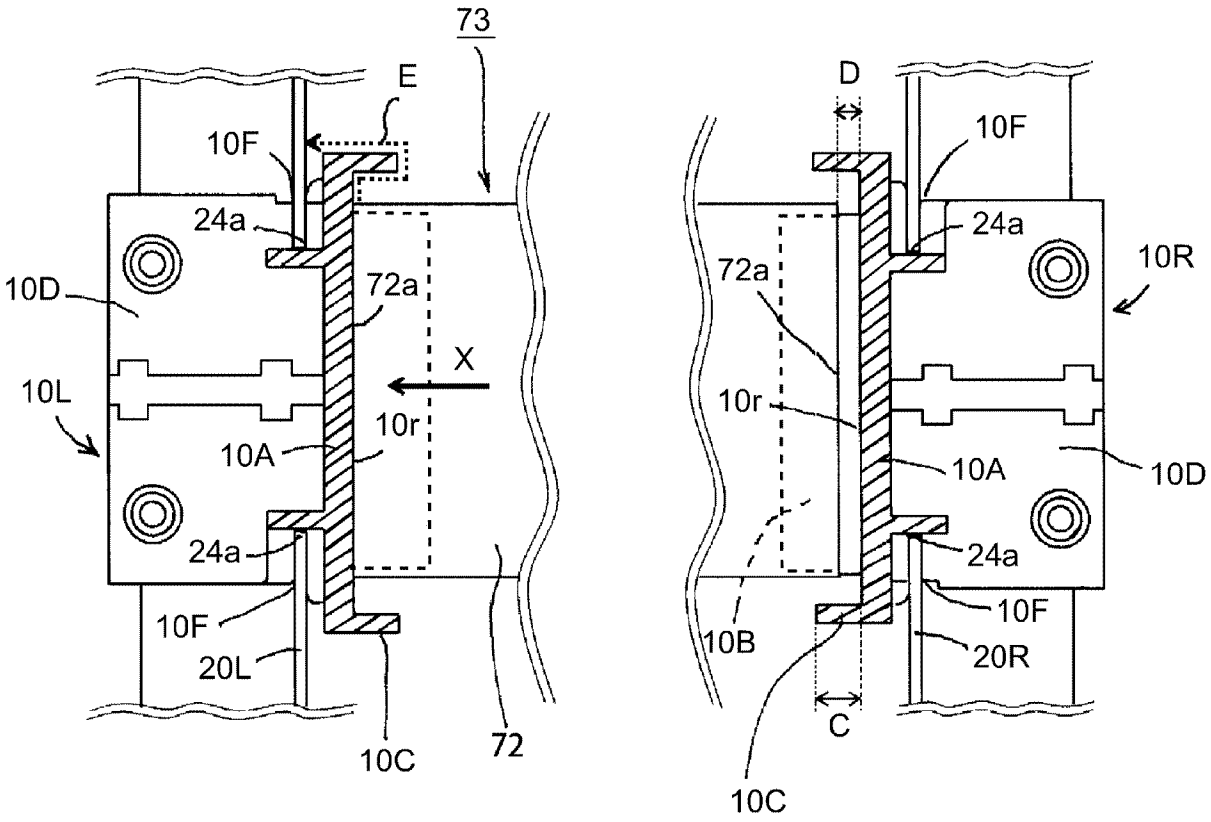

FIG. 10 is a schematic view for illustrating ensuring of an insulation distance.

Figure 11:
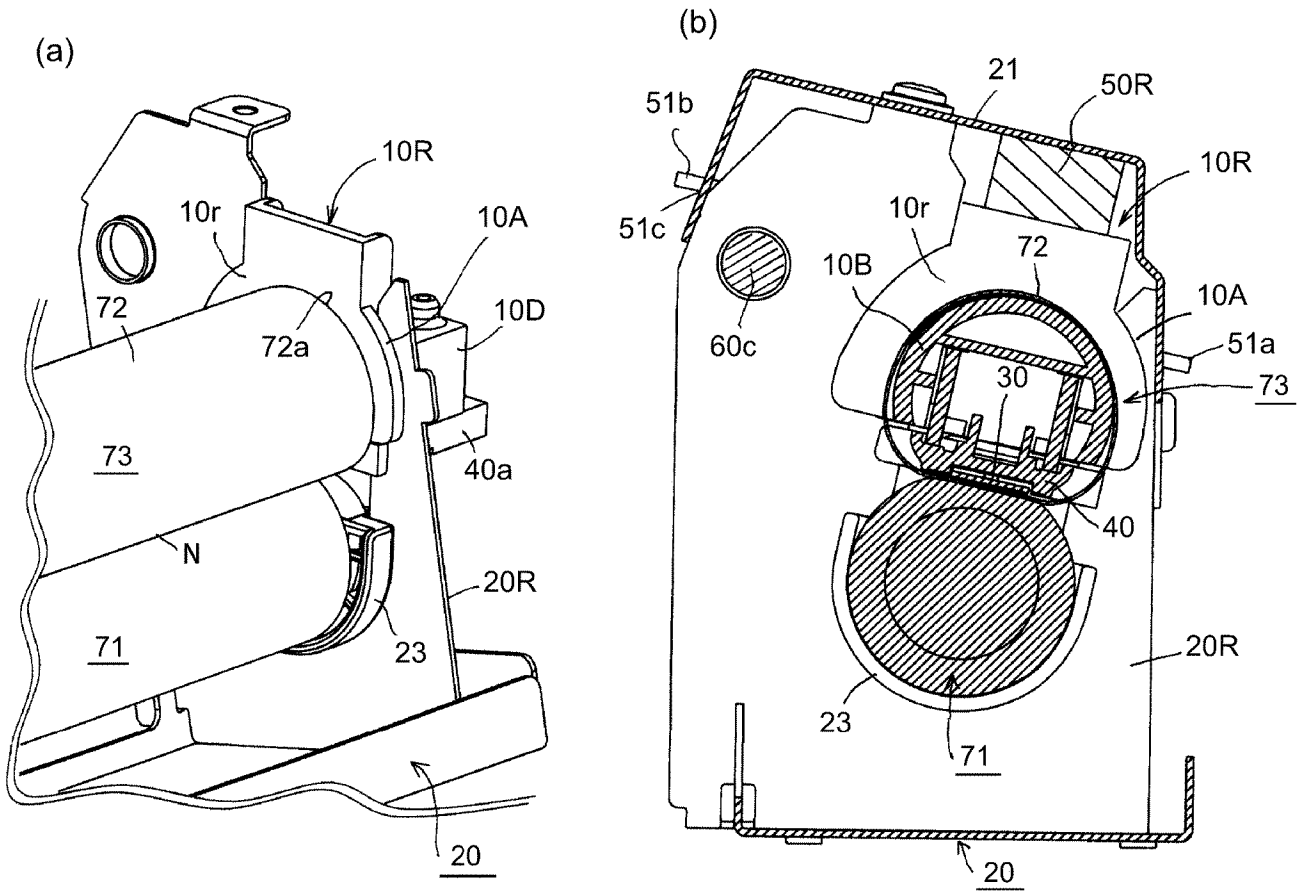
Fig. 11 RELATED ART

Parts (a) and (b) of FIG. 11 are schematic views of a fixing device in a comparison example, in which part (a) is a partially perspective view of the fixing device, and part (b) is a sectional view of the fixing device.

DETAILED DESCRIPTION OF THE PREFERRED EMBODIMENTS

Embodiment 1

[Image Forming Apparatus]

Figure 2:
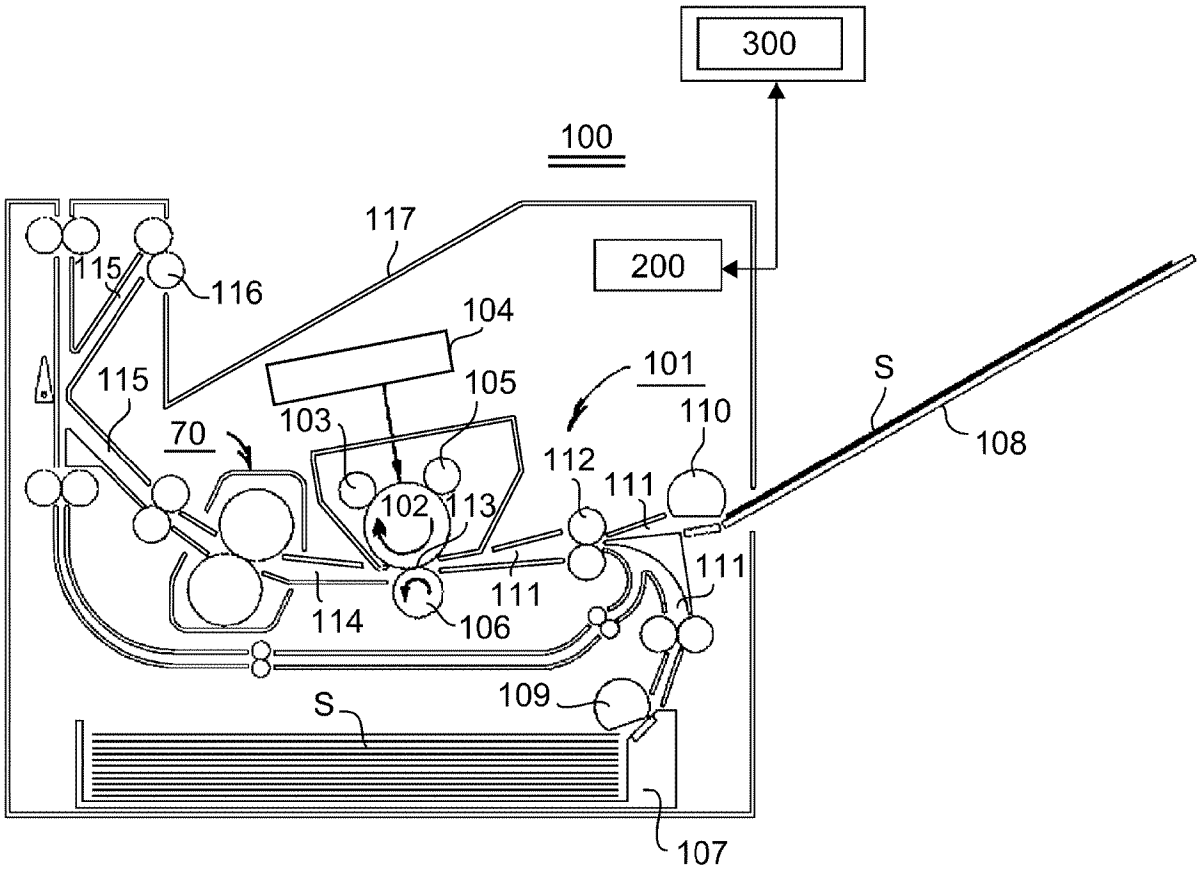
FIG. 2 is a schematic view of an example of an image forming apparatus.

FIG. 2 is a schematic view showing a general structure of an example of an image forming apparatus 100 in which an image heating apparatus is mounted as a fixing device 70 according to the present invention. The image forming apparatus 100 is a monochromatic printer using an electrophotographic process, and image information is inputted from an external device 300, such as a host computer, to a controller 200. The controller 200 executes a predetermined image forming control sequence.

An image forming portion 101 for forming a toner image on a recording material (sheet, hereafter referred to as a sheet or paper) S includes a drum shaped electrophotographic photosensitive member (hereafter, referred to as a drum) 102 rotationally driven in the clockwise direction indicated by an arrow. At a periphery of this drum 102, in the order along a rotation direction, a charging roller 103, a laser scanner unit 104, a developing device 105, and a transfer roller 106 are provided. An image forming operation (electrophotographic process) of the image forming portion 101 is well known and will be omitted from detailed description.

Sheets S accommodated in a sheet feeding cassette 107 or a feeding tray (manual feeding tray) 108 are fed one by one by rotation of a feeding roller 109 or 110. Then, the sheet S is introduced at predetermined control timing to a transfer nip 113 formed by the drum 102 and the transfer roller 106 through a feeding path 111 including a registration roller pair 112, and is subjected to transfer of the toner image formed on the drum 102 side.

The sheet S passed through the transfer nip 113 is sent to a fixing device 70 along a feeding path 114 and is subjected to the fixing process in which the toner image is fixed on the sheet S under application of not only heat, but also, pressure. The sheet S coming out of the fixing device 70 passes through a feeding path 115 and is discharged as an image formed product onto a discharger tray 117 by a discharging roller pair 116.

[Fixing Device]

As regards the fixing device 70 in this embodiment, a front surface (side) is an entrance side of the sheet S, and a rear (back) surface (side) is an exit side of the sheet S. Left and right refer to left (one end side) and right (the other end side) when the fixing device 70 is seen from the front side. Upper (up) and lower (down) refer to those with respect to a direction of gravitation. Upstream side and downstream side refer to those with respect to a sheet feeding direction (recording material feeding direction). Further, a generatrix direction of a fixing film, which is a hollow (cylindrical, sleeve shaped) rotatable member, an axial direction of a pressing roller 71 which is an opposing member, or a direction parallel to the axial direction is a longitudinal direction, and a direction perpendicular to the longitudinal direction is a widthwise direction.

The fixing device 70 is an image heating device of a film (belt) heating type enabling shortening of a rise time and low power consumption. FIG. 3 is a perspective view of an outer appearance of the fixing device 70. Part (a) of FIG. 4 is a sectional view of the fixing device 70 at a position of (4) (4) line indicated in FIG. 3, and part (b) of FIG. 4 is an enlarged view of a portion enclosed by a chain line indicated in part (a) of FIG. 3.

The fixing device 70 roughly includes a film unit (belt unit) 73, an elastic pressing roller 71 as an opposing member (pressing member), and an electroconductive (device) frame 20 that accommodates these members and that is a metal plate working product. Parts (a) and (b) of FIG. 5 are exploded perspective views of the fixing device 70, in which part (a) shows one end side (left side) of the fixing device 70 and part (b) shows the other end side (right side) of the fixing device 70.

(1) Film Unit (Belt Unit) 73

The film unit 73 includes a fixing film 72. Inside the film 72, a heater (heating member) 30, a heater holder (heating member supporting member, hereafter referred to as a holder) 40 not only holding the heater 30, but also, guiding rotation of the film 72, and a stay 45 holding the holder 40, are provided as an inner assembly. FIG. 6 is an exploded schematic perspective view of the film unit 73.

Each of the heater 30, the holder 40, and the stay 45 is an elongated member having a length longer than a width (length) of the film 72, and extends outwardly from ends of the film 72 on one end side (left side) and on the other end side (right side). The holder 40 includes outwardly projected portions 40*a*, and the stay 45 includes outwardly projected portions 45*a*. Further, fixing flanges (rotatable preventing (regulating), hereafter referred to as flanges) 10L and 10R on one end side and the other end side are mounted on the outwardly projected portions 45*a* of the stay 45 on one end side and the other end side, respectively. That is, at end portions of the film 72 with respect to the longitudinal direction, the flanges 10L and 10R are disposed.

The film 72 having flexibility is a heat conductive member having a heat resistant property. For example, the film 72 is constituted by a three layer composite layer consisting of a base layer of thin metal, an elastic layer of a silicone rubber or the like, and a surface layer of a fluorine containing resin material, or the like, in the order from an inside to an outside.

As the heater 30, a ceramic heater is used in general. This heater 30 includes a heat resistant heater substrate (ceramic substrate) formed of aluminum nitride or alumina. On the surface side of the heater substrate, a resistor pattern as a heat generating resistor generating heat by energization is formed along a longitudinal direction of the heater substrate by printing, for example. Then, the surface of the resistor pattern is coated with a gloss layer as a protective layer. The film 72 slides in close contact with a heater surface at an inner surface thereof.

On a back (rear) surface of the heater substrate, a thermistor TH (shown in FIG. 6), as a temperature detecting member for detecting a temperature of the heater 30, is provided.

The holder 40 is a member formed of a heat resistant resin material, and not only supports the heater 30, but also, functions as a rotation guide of the film 72. At a lower surface of the holder 40, a groove portion is formed along the longitudinal direction, and the heater 30 is engaged in the groove portion with its front surface outward and, thus, is supported by the groove portion. As a material of the holder 40, a heat resistant resin material such as a liquid crystal polymer, a phenolic resin material, PPS, or PEEK is used. The stay 45 is a metal rigid member formed of iron, or the like, and presses the holder 40 over a full length of the holder 40.

The flanges 10(L,R) disposed at positions opposing the end portions of the film 72 with respect to the longitudinal direction are mold products formed of the heat resistant resin material in a bilaterally symmetrical shape. As a material of the flanges 10, a glass fiber-containing material, of resins, such as PPS, liquid polymer, PET, and PA, which are excellent in heat resistant property and in sliding property and which are relatively poor in thermal conductivity, is used. In the following description, the "flange 10L" is the left side (one end side) flange, the "flange 10R" is the right side (the other end side) flange, and the "flange 10" or "flange 10(L,R)" is both of the (left side and right side) flanges.

The flanges 10 are members for preventing movement of the film 72 with respect to the longitudinal direction in contact with longitudinal end edges 72*a* of the film 72. Parts (a), (b) and (c) of FIG. 7 are schematic views of the flange 10 as seen from an inner surface side, a side surface side and a top surface side, respectively. Part (d) of FIG. 7 is a longitudinal sectional view of part (c). The flange 10 includes a flange portion 10A, a supporting portion 10B, an enclosing portion 10C, a pressure receiving portion 10D, a mounting portion 10E and a vertical groove portion 10F.

An inner surface of the flange portion 10A is a preventing (regulating) surface (rotatable member preventing (regulating) surface) 10*r* for receiving and preventing (regulating) the end edge 72*a* of the film 72.

That is, the preventing surface 10*r* is a surface opposing the longitudinal end edge 72*a* of the film 72 and performs a function of preventing movement of the film 72 in a case when the film 72 moves in the longitudinal direction, so that the film 72 remains at a predetermined position with respect to the longitudinal direction.

Each of the supporting portion 10B and the enclosing portion 10C is provided so as to project from the inner surface of the flange portion 10A, i.e., the preventing surface 10*r*. The supporting portion 10B supports an inner peripheral surface of the longitudinal end portion of the film 72 from an inside of the film 72 by an arcuate outer peripheral surface (film inner peripheral surface supporting surface) thereof and guides rotation of the film 72. That is, the supporting portion 10B performs a function of causing the film 72 to draw a desired rotation locus by regulating the longitudinal end portion of the film 72 from the inside of the film 72.

The enclosing portion 10C is provided so as to enclose the supporting portion 10B while being spaced from the supporting portion 10B on an outside of the supporting portion 10B. The enclosing portion 10C extends toward the inside of the film 72 with respect to the longitudinal direction (generatrix direction) so as to enclose the end portion of the film 72 at a position where the enclosing portion 10C is in non contact with the film 72 at the longitudinal end portion of the film 72.

The pressure receiving portion 10D is provided so as to project toward an outside of the flange portion 10A. The mounting portion 10E extends over three portions consisting of the supporting portion 10B, the flange portion 10A and the pressure receiving portion 10D. The vertical groove portion 10F is provided at each of both end portions of the flange 10 when the flange 10 is seen from the top surface of the flange 10 as shown in part (c) of FIG. 7.

The mounting portion 10E is a portion to be mounted on the outwardly projected portion 45*a* of the stay 45. The pressure receiving portion 10D directly contacts the outwardly projected portion 45*a* in a state in which the flange 10 is mounted on the outwardly projected portion 45*a* of the stay 45, and thus, performs a function of pressing down the stay 45 by a pressing mechanism, described later.

The vertical groove portion 10F is an engaging portion with side plates 20L and 20R of the frame 20. As shown in parts (a) and (b) of FIG. 5, the vertical groove portions 10F of the flanges 10 are aligned with edge portions 24*a* of slits 24 provided on the frames 20. Then, the flanges 10 are slid along the slits 24, so that the flanges are mounted on the frames 20.

(2) Pressing Roller 71

The pressing roller 71 as a second rotatable member (opposing member) forms a nip N between itself and the film 72 on the heater 30, and is a rotatable driving member for rotationally driving the film 72. The pressing roller 71 is an elastic roller that includes a core metal and an elastic layer formed on an outer peripheral surface of the core metal. The core metal is formed of SUS, SUM, Al, or the like. The elastic layer is formed of a heat resistant rubber such as a silicone rubber or a fluorine containing rubber, or formed of a foam rubber such as foamed silicone rubber. On the elastic layer, a parting layer formed of PFA, PTFE, or FEP, or the like, may also be formed.

Shaft portions of the pressing roller 71 on one end side and on the other end side are supported via bearing members 23 by the side plates 20L and 20R. To the pressing roller 71, a driving force of a driving source M1 (as shown in FIG. 9) controlled by the controller 200 is transmitted through a drive transmitting mechanism (not shown), whereby the pressing roller 71 is rotationally driven at a predetermined peripheral speed in an arrow R72 direction in FIG. 4.

In a state in which the flanges 10L and 10R are engaged with the side plates 20L and 20R, respectively, the flange portion 10A of the flange 10L is positioned inside the side plate 20L, and the pressure receiving portion 10D is positioned outside of the side plate 20L. The flange portion 10A of the flange 10R is positioned inside of the side plate 20R, and the pressure receiving portion 10D is positioned outside of the side plate 20R.

As a result, the flanges 10L and 10R are held slidably (movably) in a vertical (up down) direction relative to the side plates 20L and 20R. That is, the film unit 73 has a degree of freedom such that the film unit 73 is movable as a whole in directions of moving toward and away from the pressing roller 71 along the vertical edge portions 24*a* of the slits 24 and 24 between the side plates 20L and 20R.

(3) Pressing (Urging) Mechanism

The pressure receiving portions 10D of the flanges 10L and 10R receive predetermined pressure by being pressed (urged) by a pressing (urging) mechanism including pressing springs (elastic members) 50L and 50R and pressing levers (pressing metal plates) 51L and 51R respectively. The pressing levers 51L and 51R are provided on the pressure receiving portions 10D outside of the side plates 20L and 20R, and the free end portions 51*a* are inserted and engaged in holes 21*a* on a top plate 21 side of the frame 20 at engaging portions 51*c*. The pressing levers 51L and 51R are swingable about the engaging portions 51*c* in an up down (vertical) direction.

The pressing springs 50L and 50R are provided between the pressing levers 51L, 51R and spring receiving portions 21*b* of a one end side and on the other end side, respectively, of the top plate 21. Each of the pressing springs 50L and 50R is a coil shaped compression spring in this embodiment. Depending on a device constitution, each pressing spring 50L (50R) may also be a tension spring or another pressing mechanism.

In a free state of the pressing levers 51L and 51R, the pressure receiving portions 10D of the flanges 10L and 10R are pressed (urged) downwardly via the pressing levers 51L and 51R by a reaction force of the pressing springs 50L and 50R. Part (a) of FIG. 8 is a right side view of the fixing device 70 in this pressure applied (pressed) state. A left side surface of the fixing device 70 is symmetrical with the right side surface of the fixing device 70. An arrow Z represents a pressing direction. A center line 50*c* of the pressing spring 50R (50L) is positioned outside of the side plate 20R (20L).

The flanges 10L and 10R are mounted on the outwardly projected portions 45*a* and 45*a* of the stay 45 on one end side and on the other end side, respectively, and therefore, in the pressure applied state of part (a) of FIG. 8, also the stay 45 is pressed downwardly via the flanges 10L and 10R.

As a result, the film 72 on the holder 40 including the heater 30 press contacts the pressing roller 71 against elasticity of the elastic layer of the pressing roller 71 with a predetermined pressing force (pressure). In the fixing device 70 in this embodiment, the heater 30 and a part of the holder 40 function as a sliding member (back up member) contacting the inner surface of the film 72. For that reason, as shown in FIG. 4, the nip N having a predetermined width with respect to a sheet feeding direction (recording material feeding direction) shown by the arrow is formed between the film 72 and the pressing roller 71.

The levers 51L and 51R are extended to sides opposite from the engaging portions 51*c* with boundaries constituted by the pressure receiving portions 10D of the flanges 10L and 10R, respectively, at extended lever portions 51*b*. Below the extended lever portions 51*b*, pressure releasing cams 60L and 60R, as a pressure releasing mechanism, are provided for releasing urging of the flanges 10L and 10R by the pressing springs 50L and 50R. Incidentally, the pressure releasing cam 60L is not shown. The cams 60L and 60R are eccentric cams fixed around one end portion and the other end portion of a rotation center shaft 60*c*, rotatably supported between the side plates 20L and 20R, with the same phase.

The cams 60L and 60R are controlled by the controller 200. A driving force of a driving source M2 (as shown in FIG. 9) is transmitted to the cams 60L and 60R via a drive transmission mechanism (not shown). The cams 60L and 60R are controlled to an angle of rotation such that a small diameter portion faces upward as shown in part (a) of FIG. 8, so that the cams 60L and 60R are in non contact with the respective extended lever portions 51*b* of the pressing levers 51L and 50R. For this reason, the pressing levers 51L and 51R are in a free state, and the fixing device 70 is in the pressure applied state such that the nip N having a predetermined width is formed between the film 72 and the pressing roller 71. Processing roller 71 rotates in the direction indicated by arrow R71. Further, the cams 60L and 60R are controlled to an angle of rotation such that a large diameter portion faces upward as shown in part (a) of FIG. 8, so that the cams 60L and 60R are in contact with the respective extended lever portions 51*b* of the pressing levers 51L and 50R. The cams 60L and 60R raise the pressing levers 51L and 51R about the engaging portion 51*c* of the free end portions 51*a* with the inserting holes 21*a* against the reaction force of the pressing springs 50L and 50R, respectively. As a result, urging of the pressure receiving portions 10D of the flanges 10L and 10R by the pressing levers 51L and 51R is released. That is, formation of the nip N is released (eliminated) or the pressing force of the nip N is reduced.

Thus, the fixing device 70 is constituted so that the pressure applied state (part (a) of FIG. 8) and the pressure released state (part (b) of FIG. 8) are switchable therebetween. During non image formation, the fixing device 70 is put in the surface released state, so that elastic deformation of the elastic layer of the pressing roller 71 can be prevented. Further, when a paper jam (jamming) occurs during sheet passing, the sheet can be easily removed from the nip N by switching the state of the fixing device 70 from the pressure applied state to the pressure released state.

(4) Fixing Operation

FIG. 9 is a block diagram of a control system of the fixing device 70. The controller 200 starts control of an image forming operation sequence of the image forming apparatus 100 on the basis of an image formation start signal. The controller 200 controls the driving source M2, so that the state of the fixing device 70 is switched from the pressure released state (part (b) of FIG. 8) to the pressure applied state (part (a) of FIG. 8). Further, by actuating the driving source M2, the pressing roller 71 is rotationally driven.

By this rotation of the pressing roller 71, based on a frictional force between the pressing roller 71 and the film 72 at the nip N, a rotational force acts on the film 72. As a result, the film 72 is rotated by the rotational force in an arrow R72 (FIG. 4) while being slid at its inner surface with the surface of the heater 30 and a part of the outer surface of the holder 40.

On the other hand, the heater 30 is supplied with electrical power from an energizing portion 201, controlled by the controller 200, through an energizing path (not shown) and abruptly generates heat. A temperature of this heater 30 is detected by a thermistor TH provided in contact with a back (rear) surface of the heater 30, and detected temperature information is inputted to the controller 200. The controller 200 properly controls a current caused to flow from the energizing portion 201 depending on the detected temperature information and increases the temperature of the heater 30 to a predetermined temperature, so that temperature control is carried out.

Thus, in a state in which the pressing roller 71 is rotationally driven and the film 72 is driven with the rotational drive of the pressing roller 71 and then, the heater 30 is increased in temperature to the predetermined temperature, the sheet S carrying the unfixed toner image is introduced from the image forming portion 101 side to the nip N. The sheet S is introduced to the nip N so that a carrying surface of the unfixed toner image T faces the film 72, and is nipped and fed. As a result, the unfixed toner image T on the sheet S is fixed as a fixed image by being heated and pressed. The sheet S passed through the nip N is curvature separated from the surface of the film 72 and is fed and discharged from the fixing device 70.

Here, to the film 72, a predetermined bias voltage is applied from a bias applying voltage (power) source 202 through a bias applying path. Although the bias applying path is omitted from illustration in the figures, for example, a constitution in which an electroconductive brush (electrode member) for bias voltage application is contacted to the electroconductive layer of the film 72 is employed. By this application of the bias voltage, the unfixed toner (image) on the sheet S is properly fixed on the sheet S without being deposited on the film 72 and the pressing roller 71.

(5) Ensuring Constitution of Insulation Distance Between Film and Frame

Figure 1:
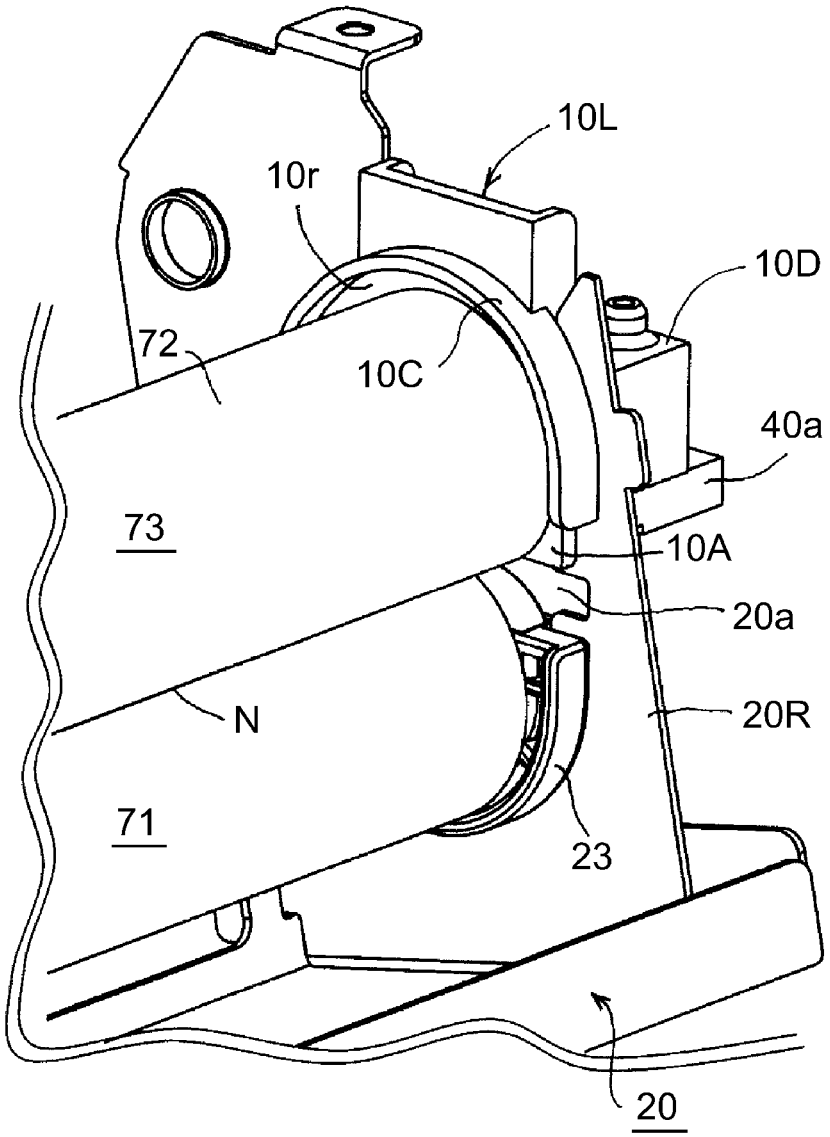
FIG. 1 is a perspective view of a part of a fixing device on an end side as seen from an inside of a side plate of the fixing device.

An ensuring constitution of an insulation distance between the film 72 and the frame 20 in the fixing device 70 will be described principally using FIGS. 1, 4, and 10. FIG. 1 is a perspective view of a part of the fixing device 70 on the other end side as seen from an inside of the side plate 20R, and FIG. 10 is a schematic view for illustrating the ensuring constitution of the insulation distance.

In the fixing device 70 in this embodiment, the flange 10, which is a member for preventing movement of the film 72 with respect to the longitudinal direction by contacting the end edge 72*a* of the longitudinal end portion of the film 72 of the film unit 73, includes the enclosing portion 10C. This enclosing portion 10C is disposed so as to enclose the outer peripheral surface of the longitudinal end portion of the film 72. The enclosing portion 10C is provided at a position sufficiently spaced from the film 72 in a radial direction of the film 72 so as not to contact the film 72 not only when the rotation of the film 72 is at rest, but also, during the fixing process in which the film 72 rotates. Further, the enclosing portion 10C is a portion extending from the preventing surface 10*r* toward a film central portion with respect to the longitudinal direction (generatrix direction) so as to enclose an outer periphery of the end portion of the film 72. As shown in FIG. 10, an electrical creepage distance E between the film 72 and the frame 20 follows a shape of the enclosing portion 10C, and therefore, becomes long. As a result, an electrical insulation distance from the film 72 to the frame 20 can be ensured, so that it is possible to prevent leakage of the bias voltage, applied to the film 72, toward the frame 20.

As described above, the enclosing portion 10C is disposed in non contact with the film 72 with respect to a radial direction of the film 72, so that smooth rotation of the film 72 and prevention of abrasion (wearing) of the outer peripheral surface of the film 72 can be realized.

In this embodiment, as shown in part (b) of FIG. 4, a spacing distance B between the supporting portion 10B and the enclosing portion 10C with respect to the radial direction of the film 72 on a side downstream of the nip N with respect to the film rotational direction is constituted so as to be larger than a spacing distance A between the supporting portion 10B and the enclosing portion 10C with respect to the radial direction on a side upstream of the nip N with respect to the film rotational direction. As a result, a constitution in which, also in the case when the film 72 deforms toward the downstream side of the nip N when the film 72 rotates in the arrow R72 direction, a proper distance can be ensured between the film 72 and the enclosing portion 10C is employed.

A projection amount C (FIG. 10) of the enclosing portion 10C toward the inside of the film 72 with respect to the longitudinal direction of the film 72 is set at a height (length) in which the insulation distance between the film 72 and the frame 20 can be ensured. In this embodiment, a constitution as shown in FIG. 10 is employed. Specifically, when the film 72 is shifted toward and abutted against the preventing surface 10*r* in an X direction on one end side with respect to a thrust direction of the film 72, a distance D between the end edge 72*a* of the film 72 on the other end side and the preventing surface 10*r* of the frame 10R is constituted so as to be less than the projection amount C of the enclosing portion 10C.

Accordingly, even when the film 72 is in any position with respect to the thrust direction, the enclosing portion 10C encloses the end edge 72*a* of the film 72, so that the insulation distance between the film 72 and the frame 20 can be ensured.

Further, the side plates 20L and 20R of the frame 20 include cut away portions 20*a* in regions (in which the enclosing portions 10C do not exist with respect to a circumferential direction of the film 72) where the film 72 cannot be enclosed by the flanges 10L and 10R. In a region close to the pressing roller 71, the enclosing portion 10C cannot be provided for avoiding contact between the flange 10 and the pressing roller 71. For that reason, by providing the side plates 20L and 20R of the frame 20 with the above described cut away portions 20*a*, the direction between the film 72 and the frame 20 is ensured.

As described above, the flange 10 is provided with the enclosing portion 10C. As a result, compared with a constitution when the flange 10 is not provided with the enclosing portion 10C, as in a fixing device in a comparison example shown in FIG. 11, it is possible to provide a fixing device in which the electrical insulation distance between the film 72 and the frame 20 is sufficiently ensured.

OTHER EMBODIMENTS (1) In the fixing device 70 in the above described embodiment, the flanges 10L and 10R are provided on one end side and on the other end side, respectively, of the film 72. However, when the fixing device is constituted so that the shift (movement) direction of the film 72 is exclusively one direction, a single flange 10 can be provided on a shift (movement) side of the film 72.

(2) The sliding member (back up member) provided inside of the film 72 may also be a member other than the heater 30.

(3) The heating means for heating the film 72 is not limited to the heater 30. It is possible to employ appropriate heating constitutions, using other heating means, such as a halogen heater and an electromagnetic induction coil, such as an internal heating constitution, an external heating constitution, a contact heating constitution, and a non contact heating constitution.

(4) A device constitution in which the film 72 is the rotatable driving member, and the pressing roller 71 is rotated by the rotation of the film 72 can also be employed.

(5) In this embodiment, as the image heating apparatus, the fixing device for fixing the unfixed toner image formed on the recording material through heating was described as an example, but the present invention is not limited thereto. The present invention is also applicable to a device (glossiness improving device) for improving glossing (glossiness) of an image by re heating a toner image fixed or temporarily fixed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating device for heating a toner image while nipping and feeding a recording material carrying the toner image at a nip, said image heating device comprising:

a cylindrical film;

an opposing member opposing said film to form the nip between said opposing member and said film;

an electroconductive frame; and a preventing member provided on said frame to prevent movement of said film and including a preventing surface contacting an end edge of said film when said film moves in a longitudinal direction thereof, wherein said preventing member includes an enclosing portion extending from said preventing surface toward a central portion of said film with respect to the longitudinal direction so as to enclose an outer peripheral surface of a longitudinal end portion of said film, said enclosing portion being provided at a position at which said enclosing portion is in non-contact with the outer peripheral surface of said film with respect to a radial direction of said film.

2. An image heating device according to claim 1, wherein said preventing member includes a supporting portion supporting an end portion of said film with respect to the longitudinal direction of said film from an inside of said film, and wherein a distance with respect to the radial direction between said supporting portion and said enclosing portion on a side downstream of the nip with respect to a rotational direction of said film is greater than a distance with respect to the radial direction between said supporting portion and said enclosing portion on a side upstream of the nip with respect to the rotational direction of said film.

3. An image heating device according to claim 1, wherein said preventing member includes a first preventing member opposing one end edge of said film with respect to the longitudinal direction of said film and a second preventing member opposing the other end edge of said film with respect to the longitudinal direction of said film, and wherein a projection amount of said enclosing portion of one preventing member of said first and second preventing members is greater than a distance between said one end edge of said film and said one preventing member when said film contacts said preventing surface of the other preventing member.

4. An image heating device according to claim 1, wherein said frame includes a cut-away portion provided in a region of absence of said enclosing portion of said preventing member with respect to a circumference direction of said film.

5. An image heating device according to claim 1, further comprising a heater configured to heat said film, wherein said heater contacts an inner surface of said film.

6. An image heating device according to claim 5, wherein said heater forms the nip in cooperation with said opposing member through said film.

7. An image heating device according to claim 1, further comprising a back-up member provided inside said film, wherein said back-up member contacts an inner surface of said film.

8. An image heating device according to claim 7, wherein said back-up member forms the nip in cooperation with said opposing member through said film.

9. An image heating device according to claim 1, wherein said preventing member is formed of a heat resistant resin material.

10. An image heating device according to claim 1, wherein said enclosing portion has an arc-shape along the outer peripheral surface of said film.

11. An image heating device according to claim 1, wherein said preventing member includes a supporting portion supporting an end portion of said film with respect to the longitudinal direction of said film from an inside of said film, and wherein a length of said supporting portion in the longitudinal direction of said film is greater than a length of said enclosing portion in the longitudinal direction of said film.

* * * * *